United States Patent [19]

Lastinger

[11] 4,168,745

[45] Sep. 25, 1979

[54] HEAT EXCHANGER

[75] Inventor: William R. Lastinger, Clearwater, Fla.

[73] Assignee: The American Equipment Systems Corporation, Clearwater, Fla.

[21] Appl. No.: 857,278

[22] Filed: Dec. 5, 1977

[51] Int. Cl.[2] ..... F28D 7/10

[52] U.S. Cl. ..... 165/164; 62/238; 165/135; 165/156

[58] Field of Search ..... 62/129, 238 B, 238 E, 62/513; 165/164, 135, 156

[56] References Cited

U.S. PATENT DOCUMENTS

| | | | |
|---|---|---|---|
| 1,740,300 | 12/1929 | Heuszey | 165/156 X |
| 1,904,361 | 4/1933 | Egloff et al. | 122/4 R |
| 1,937,288 | 11/1933 | McGraw | 62/184 |
| 1,965,553 | 7/1934 | Lear | 62/390 X |
| 1,971,242 | 8/1934 | Wheeler | 126/271 |
| 2,125,842 | 8/1938 | Eggleston | 62/238 |
| 2,278,889 | 4/1942 | Maiuri | 62/513 |
| 2,621,903 | 12/1952 | Cohler | 165/11 |
| 2,690,649 | 10/1954 | Borgerd | 62/158 |
| 2,716,866 | 9/1955 | Silva | 62/196 R |
| 2,783,618 | 3/1957 | Mills | 62/380 |
| 3,285,334 | 11/1966 | Pasternak | 165/172 |
| 3,739,842 | 6/1973 | Whalen | 165/164 |
| 3,922,876 | 12/1975 | Wetherington et al. | 62/180 |

FOREIGN PATENT DOCUMENTS

| | | | |
|---|---|---|---|
| 687624 | 6/1964 | Canada | 165/156 |
| 829103 | 2/1960 | United Kingdom . | |
| 1110041 | 4/1968 | United Kingdom . | |

*Primary Examiner*—C. J. Husar
*Assistant Examiner*—Conrad Berman
*Attorney, Agent, or Firm*—Donald D. Jeffery

[57] ABSTRACT

A heat exchanger comprising a refrigerant tube in coil form leading from the output side of a compressor and a water tube in coil form tapped from a source of water to be heated, the tubes being coiled together so that each coil of the water tube is interposed between a coil of said refrigerant tube, and vice-versa. Inner and outer cylindrical sleeves are disposed within and around the coiled tubes thereby defining an annulus which enhances the heat transfer from said refrigerant tube to the water tube. A housing surrounds said coiled tubes and said sleeves, and sealed end caps are provided at each end of the exchanger.

11 Claims, 2 Drawing Figures

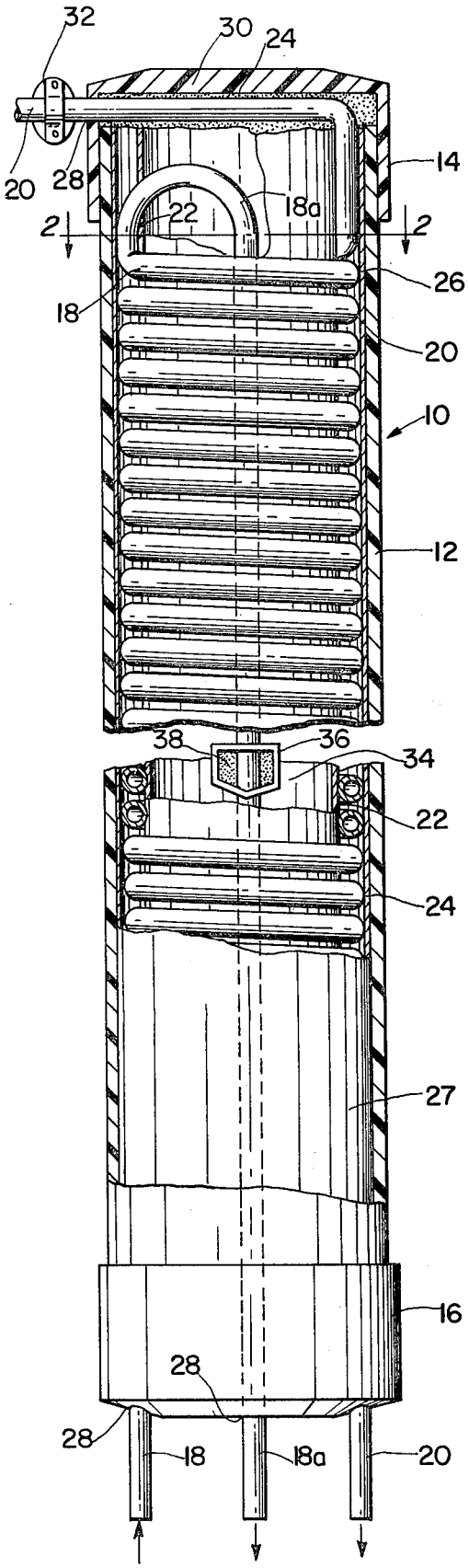
FIG. 1
FIG. 2
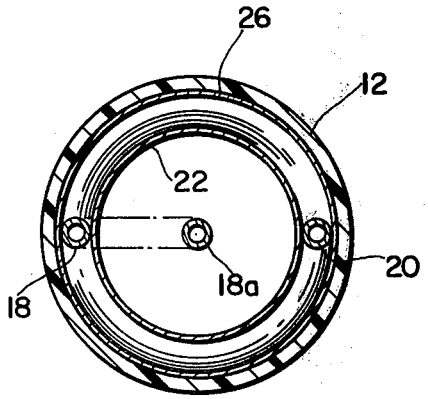

HEAT EXCHANGER

BACKGROUND OF THE INVENTION

The present invention relates as indicated to a heat exchanger, and more particularly to a heat exchanger finding particularly advantageous use in residential dwellings or commercial installations having an air-conditioner or heat pump.

Inherent in the operation of an air-conditioning system or heat pump is the creation of waste heat which is normally dissipated to the atmosphere. In a typical installation, a central air-conditioning system will have the compressor and finned condenser tubes located in a housing positioned in or near the dwelling, with the evaporator coil being positioned within the house for circulation of air thereover by a circulating fan to cool the entire enclosure. A heat pump, which is finding increasingly greater uses due to the versatility thereof, is essentially the same except that the system is reversible whereby the interior coil can be cooled or heated as desired. When the heat pump is used for air-conditioning purposes, the coil located outside of the house functions as the condensing coil and similarly creates heat, which is dissipated to the atmosphere by a fan.

The basic objective of the present invention is to efficiently employ the waste heat from the refrigerant by providing heat exchange apparatus in which the hot refrigerant gas is passed in heat exchange relationship with water used interiorly of the house and which is normally heated by independent, energy-consuming means such as gas or electricity. For example, the heat exchanger in accordance with the present invention is particularly adapted to augment the heat source for the domestic water heater thereby reducing the energy requirements for heating the water. Concomitant with the reduced energy requirements for water heating is the reduction in temperature of the refrigerant due to such heat exchange, thereby making the refrigeration cycle more efficient and therefore less demanding on the compressor, a very significant commercial advantage.

The basic concept of employing waste heat from a refrigerant compressor for heating water is well known in the art. For example, U.S. Pat. No. 2,690,649 to Borgerd discloses a coil which is tapped off from the high pressure side of the compressor 10 for passage through a water tank to heat the water therein. U.S. Pat. No. 1,937,288 to McGraw shows a similar arrangement, and this basic concept of employing the waste heat for a heat pump or compressor is also shown in U.S. Pat. Nos. 2,716,866 and 2,125,842.

A further aspect of the present invention involves the interpositioning of coiled tubes containing refrigerant and water in a generally cylindrical assembly thereby to enhance the heat exchange between the refrigerant contained in one coiled tube and the water passing through the adjacent coiled tube. The basic concept of providing adjacently disposed tubes through which pass different materials for purposes of heat exchange is disclosed in U.S. Pat. No. 1,965,533 to Lear and in U.S. Pat. No. 3,285,334 to Pasternak, although the use environments are substantially different than in accordance with the present invention. U.S. Pat. No. 2,621,903 to Cohler also discloses adjacently disposed coils of tube through which differing liquids pass for heat exchange purposes. However, the relevance of Cohler is limited to this feature inasmuch as there is no complete heat exchanger structure disclosed in the patent.

SUMMARY OF THE INVENTION

The present invention provides heat exchange apparatus constructed to maximize the heat exchange from the refrigerant line to the water line passing through tubing coiled adjacent to the refrigerant coil. In accordance with the invention, a coil containing refrigerant, for example, Freon, is tapped off the hot line from the compressor, with the coiled section being enclosed in the housing in adjacent coiled relation with liquid to be heated, for example water. Preferably, the coiled tubes are soldered together throughout their coiled length in which they are adjacently disposed. As above noted, the present invention is particularly adaptable to supplement the heating of water passed to the coil from the cold end of the domestic water heater, with the water as heated in the exchanger being returned to the hot end of the water heater or elsewhere in the hot water system, as desired. Subsequent to passing through the heat exchanger, the refrigerant is passed to the condenser and thereafter passes through the refrigeration system for eventual return to the inlet side of the compressor in the usual manner.

A further feature of the invention is to position within the inner and outer diameters of the adjacently disposed coils closely adjacently disposed sleeves so as to confine heat radiation from the refrigerant coil to the annulus between the sleeves in which the coiled tubes are positioned. Both the inner and outer sleeves are preferably covered with reflective material to reduce the radiation lose. Maximum heat exchange between the refrigerant and the water is thus effected. In addition, HUD requirements as stated in paragraph S-515-1.9 of Standard 4930.2 entitled "Solar Heating and Domestic Hot Water Systems", Vol. 5, 1977 edition are met inasmuch as the water to be heated is protected by a double wall thickness from the refrigerant which arrangement is required in the event of leakage of the refrigerant tube.

The refrigerant and water coils and surrounding sleeves are housed within an enclosure having separate end caps containing an opening or openings through which the coil ends extend at each end of the housing. Thus, the inlet and outlet ends of the refrigerant tube are exposed for convenient assembly to the refrigerant system, and the water line can likewise be readily hooked up as desired. The end of each housing below the cap is sealed, and a heat sink device extends around the outlet end of the refrigerant return pipe within the cap for heat absorption purposes. In addition, a thermostatic device is positioned on the water line exteriorly of the cap for measuring the temperature of the water entering the heat exchanger.

BRIEF DESCRIPTION OF THE APPLICATION DRAWINGS

FIG. 1 is a side elevational view, partially broken away and sectioned, showing the heat exchanger in accordance with the present invention, and FIG. 2 is a cross-sectional view taken on line 2—2 of FIG. 1.

DETAILED DESCRIPTION OF THE PREFERRED EMBODIMENTS

Referring now in more detail to the application drawings, wherein like parts are indicated by like reference numerals, the heat exchanger in accordance with the invention is generally indicated at 10 and comprises a cylindrical housing 12 and end caps 14 and 16 which extend over and enclose the housing at each open end thereof, as shown in FIG. 1. During final assembly of the exchanger, the caps 14 and 16 can be temporarily or permanently secured to the housing by bonding, fastening means, or the like.

Positioned within the housing are tubular members 18 and 20 wound in helical form around an inner sleeve member 22. The tube 18 carries the hot refrigerant, for example, Freon, from the outlet side of the compressor of the heat pump or air-conditioning system, and the tube 20 carries the water to be heated by the waste heat from the Freon. As previously noted, the coiled Freon tube passing through the heat exchanger may comprise a simple by-pass from the Freon line which normally passes from the compressor directly into the condensing coils. Thus, the outlet end of the Freon tube 18 is directed back to the condenser of the air-conditioning system, with the temperature of the Freon being reduced due to the heat exchange, with consequent advantages in the air-conditioning system as will be discussed in more detail hereinbelow. The water passing through tube 20 can be diverted from any domestic water supply source requiring heat, for example, a water heater normally heated by gas or electricity, with consequent savings in energy. The water can also be diverted from the main water line in route to the water heater, rather than forming a closed coil loop with the hot and cold ends of the heater. The heat exchanger is also readily adaptable for use with additional supplemental heating means such as solar collectors and other types of devices utilizing solar heat. The heat derived from the heat exchanger coupled with an additional source of solar heat frequently can substantially fulfill total heat requirements for the water.

The tubes 18 and 20 are wrapped around the inner sleeve 22 such that each coil of the refrigerant tube 18 has positioned on either side thereof the water tube 20, and vice versa. The tubes are preferably wrapped around the sleeve as tightly and as close together as possible in order to enhance the heat exchange effect, and are preferably soldered together, as above noted. In order to still further improve the heat transfer, the sleeve 22 is preferably wrapped around both the inside and outside with reflective material, for example 20 gauge aluminum foil, with the foil covering the inner surface of the sleeve 22 being shown at 24. The refrigerant line 18 is coiled back as shown at 18*a* in FIG. 1, with the return end being straight and extending downwardly through the interior of the exchanger.

A sleeve 26 extends over the outer circumference of the coiled tubes 18 and 20 and in the form shown is positioned fairly tightly within the cylindrical housing 12. The outer sleeve 26, like the inner sleeve 24, is preferably provided with reflective wrappings 27 on both the outside and inside surfaces thereof, for example, 20 gauge aluminum foil. The inner reflective surface serves to retain the heat from the refrigerant tube within the annulus between the sleeves 22 and 26 to enhance heat transfer to the water tube 20.

Each end cap 14 and 16 is provided with openings commonly designated at 28 through which the inlet and outlet ends of the tubes 18 and 20 extend. As shown in the upper part of FIG. 1, the end of the tube 20, through which cool water enters the exchanger, is wrapped around the inner sleeve 22 and passes through an opening 28 formed in the side of the cap 14. The hot and cool refrigerant lines 18 exit through openings formed in the bottom cap 16, and the hot water line 20 likewise passes out through an opening in the cap 16.

Prior to final assembly of the heat exchanger a sealing compound such as commercially available boiler paste is disposed around the tubes and above the sleeves 22 and 26 so as to seal the top and bottom of the exchanger after the cap has been positioned in place. The boiler paste serves to retain the position of the members within the cap and also serves to reduce the heat loss through the caps.

The water enters at the top of the exchanger, passes through tube 20 and exits at the bottom of the exchanger, as shown in FIG. 1. The water absorbs substantial heat from the hot refrigerant, and in order to monitor and control the temperature of the water, a thermostat 32 is installed on inlet end of the water tube 20 exteriorly of the top cap. The thermostat can be of any conventional construction, for example, a bimetallic switch assembly, and functions to shut off the pump for the water line when the inlet temperature exceeds, for example, 140° F. This precludes the water leaving the exchanger from reaching an undesirably high temperature.

The tubes 18 and 20 are preferably formed of metallic material, and more preferably, copper. In view of the high heat conductivity of copper, there is substantial heat loss along the portions of the tubes 18 and 20 not in contact with the sleeves. In order to reduce this conductive heat loss, a heat sink device 34 may be employed and in the form shown is positioned around at least the refrigerant return line 18*a*. The device includes a generally cylindrical capsular housing 36 and a heat absorbing paste 38 within the housing contacting the tube 18*a*. The device 34 per se forms no part of the present invention, and functions to reduce heat loss as described, with the consequent advantage of reducing load on the compressor. It will be apparent that other types of heat sinks or dissipators can be employed, and that such devices can be operatively mounted in the heated end of the water tube 20 as well.

It will be seen that the heat exchanger is simple in construction and inexpensive to manufacture. In assembling the exchanger, the coils 18 and 20 are wrapped around the inner sleeve 22 after the latter has been wrapped with heat reflective and insulating material as above described. The tubes are formed with straight end portions at both ends thereof. The outer sleeve 26, also wrapped as described, is thereafter positioned around the coil tubes, and the resulting assembly placed in the cylindrical housing 12. The latter can be formed of any suitable, preferably plastic material such as polyvinylchloride or the like. The heat sink device 34 is positioned over the refrigerant return line, which is bent to extend straight downwardly through the center of the exchanger. Boiler paste or other suitable insulating compound is thereafter positioned around the tubes, and more preferably across the open ends of the assembly. The end caps 14 and 16 are then positioned by aligning the opening or openings 28 in the end caps with the tubes 18 and 20, which may be bent as necessary to achieve the necessary alignment. The caps are thereafter secured in place in any suitable manner to complete the assembly. It will be understood that following such assembly, the terminal ends of both the refrigerant and water tubes are suitably coupled to the water and refrigerant lines by junctions, welding, or other known methods of assembly which per se form no part of the present invention.

Although in the form shown, the cylindrical housing 12 is employed to fully enclose the coiled tubes, it will be understood that it may be preferred in certain installation environments to position the coiled tubes in relatively larger enclosures. In such event, in lieu of the housing 12, suitable insulating packing, for example, polyurethane foam, is disposed in appropriate amounts around the outer sleeve 26 for insulating and retaining the coiled tubes and sleeve. In such installation the end caps 14 and 16 could also be eliminated, but the heat sink device 34 and thermostat 32 would be preferably retained for the reasons above noted. However, the illustrated form of heat exchanger is preferred in view of the simple and inexpensive manufacture, ease of incorporation into the air-conditioning or heat pump system, and the esthetic appearance of the unit.

As above noted, the heat exchanger in accordance with the invention is energy saving in two respects. The energy consumption otherwise required in heating water for domestic use is reduced since at least a portion of the water supply is heated by the waste heat from the refrigerant. Secondly, the temperature of the refrigerant passing through the heat exchanger is substantially reduced due to the heat exchange thereby permitting the air-conditioning system or heat pump to operate more efficiently. A fan is normally required to blow hot air off the condensing coils, with the blown air in high ambient temperatures frequently being quite hot. By cooling the refrigerant before the same is passed through the condenser coil, the compressor can operate much more efficiently, with tests showing that amperage can be reduced by at least as much as one-third, a significant savings in energy. Moreover, the life span of the compressor can be prolonged, a significant commercial advantage.

To illustrate the reduced energy requirements of the compressor, a test was made at the residence of applicant, on a "Weatherking" heat pump manufactured by Addison Products Company. The heat pump was labeled to indicate that it will draw 20.5 amps while in operation. A permanent ammeter was installed on this unit and over several months of testing the heat pump continuously drew 13.5 amps when used in conjunction with the heat exchanger. In a further test installation a 4-ton "Fedders" heat pump, labeled to indicate that it should draw 29 amps of current, actually drew 17.5 amps of current when the meter was inspected on numerous occasions. This reduced current usage results in substantial energy savings as well as permitting the heat pump to operate much more efficiently.

In order to determine the energy saved in heating the water in accordance with the present invention, tests were conducted to determine the kilowatts which would otherwise be required to heat the water directed to the heat exchanger from the domestic water heater. The following chart constitutes the test results.

| TIME (Min.) | $T_{in}$ (°F.) | $T_{out}$ (°F.) | Q(Gallons) |
|---|---|---|---|
| 0 | 78 | 90 | 37340.0 |
| 5 | 80 | 88 | 37352.0 |
| 10 | 80 | 87 | 37365.4 |
| 15 | 81 | 89 | 37379.1 |
| 20 | 81 | 89 | 37392.6 |
| 25 | 80 | 88 | 37406.0 |
| 30 | 80 | 88 | 37420.0 |
| 35 | 80 | 88 | 37433.0 |

-continued

| TIME (Min.) | $T_{in}$ (°F.) | $T_{out}$ (°F.) | Q(Gallons) |
|---|---|---|---|
| 40 | 80 | 88 | 37446.2 |
| 45 | 80 | 88 | 37459.6 |
| 50 | 80 | 89 | 37473.6 |
| 55 | 80 | 89 | 37488.7 |
| 60 | 80 | 89 | 37499.1 |

It will be seen that the test was conducted over a period of 60 minutes. The average temperature of the water passing into the heat exchanger was 80° F., and the average temperature of the water passing from the heat exchanger following the heat transfer was 88.5° F. The gallons of water passed through the heat exchanger during such time was 159.1 gallons, obtained by subtracting the initial meter reading in the last column from the final meter reading of the end of the 60 minute period.

The amount of heat transferred to the water in Btus is expressed by the following formula and calculations:

$$q = Q\rho w \Delta T$$

$$= 159.1 \text{ gal. } (8.331\#/\text{gal.}) (8.5° \text{ F.})$$

$$= 11{,}266.4 \text{ Btus,}$$

wherein Q is the gallons of water treated (159.1), $\rho w$ is the equation constant and $\Delta T$ is the average increase in temperature of the water passing through the heat exchanger. This calculation results in total heat of 11,266.4 Btus for the entire 60 minute period.

The total heat as expressed in Btus can be translated into kilowatt energy by the following equation and calculations:

$$P = q/t$$

$$= [11{,}266 \text{ Btu}/60 \text{ min.}]$$

$$= 187.8 \text{ Btu/Min.}[0.01758 \text{ kw/Btu/Min.}]$$

$$= 3.3 \text{ kilowatts}$$

The above tests were conducted with the ambient air temperature 76° F. at the beginning of the testing and 80° F. at approximately midway through the testing.

It will thus be seen that the heat exchanger provides an energy saving of 3.3 kilowatts for each hour of use, thereby reducing to that extent the amount of energy otherwise required in heating the water for domestic consumption, as well as reducing the energy requirements for the compressor. This duplex mode energy saving is estimated to reduce energy consumption in the air-conditioning system by approximately one-third, and approximately two-thirds of the heating requirements for the hot water heater, assuming normal use thereof. The significant heat transfer achieved is essentially due to the coiled, superposed tube arrangement and the cylindrical sleeves positioned inside and outside the coiled tubing, with the sleeves serving to confine the heat transfer to the annulus therebetween.

It will be apparent that minor modifications can be made in the heat exchanger without departing from the invention concepts. It will also be apparent that additional safety features can be provided for monitoring the refrigerant and water. For example, the refrigerant tube can be protected by high and low pressure cutoff switches, and the water tube can be provided with a pressure relief valve in addition to the thermostatic control disclosed above.

I claim:

1. A heat exchanger comprising:

(a) a refrigerant tube in coil form leading from the output side of a compressor of an air-conditioning system or heat pump;

(b) a water tube in coil form, said water tube being connected to a source of water to be heated, said water and refrigerant tubes being coiled together so that each coil of said water tube is interposed between a coil of said refrigerant tube, and vice-versa;

(c) an inner cylindrical sleeve around which the inner surfaces of said coiled tubes are wrapped;

(d) an outer cylindrical sleeve positioned closely around the outer surfaces of said coiled tubes, said inner and outer cylindrical sleeves defining an annulus therebetween thereby enhancing the heat transfer from said refrigerant tube to said water tube, and (e) housing means surrounding said coiled tubes and said sleeves.

2. The heat exchanger of claim 1 further including thermostat means operatively associated with the inlet end of said water tube for monitoring the temperature of the water entering the heat exchanger.

3. The heat exchanger of claim 1 further including sealing means provided at the base of each end cap for enclosing said annulus between said outer and cylindrical sleeves and sealing the entire open area between the end of said cap and said sleeves.

4. The heat exchanger of claim 1 wherein said housing means comprises a cylindrical housing member positioned around and closely adjacent to said outer cylindrical sleeve, end caps positioned over said housing for enclosing said sleeves and said housing, said end caps being formed with openings for receiving straight end portions of said refrigerant tube and said water tube at both ends of said exchanger, and sealing means within the base of each end cap for sealing each end of said heat exchanger.

5. The heat exchanger of claim 1 wherein said refrigerant and water tubes are of copper, and further including end caps, said housing and end caps being formed of plastic material.

6. The heat exchanger of claim 1 wherein said refrigerant and water tubes are soldered together throughout their coiled length in which they are adjacently disposed, thereby provided improved heat exchange between the tubes and enhancing the rigidity of the heat exchanger.

7. The heat exchanger of claim 1 wherein said housing means comprises a cylindrical housing member positioned around and adjacent to said outer cylindrical sleeve, end caps positioned over said housing for enclosing said sleeves and said housing, at least one of said end caps being formed with openings for receiving end portions of said refrigerant and water tubes, means for sealing the base of each end cap, and wherein said refrigerant and water tubes are soldered together throughout their coiled length in which they are adjacently disposed.

8. The heat exchanger of claim 1 wherein said housing means comprises a cylindrical housing disposed around and closely adjacent to said outer cylindrical sleeve.

9. The heat exchanger of claim 8 further including end caps positioned over the cylindrical housing and enclosing the ends of said housing, said coil tubes and said inner and outer cylindrical sleeves.

10. The heat exchanger of claim 9 wherein said coils are formed with end portions at each end thereof and said end caps are formed with openings for receiving said end portions, the latter extending exteriorly of said end caps for suitable connection to the refrigerant and water lines.

11. The heat exchanger of claim 10 wherein the cool refrigerant return line has positioned therearound a heat sink device for reducing the conductive heat loss through said line at the outlet end thereof.

* * * * *